United States Patent [19]

Bell

[11] 4,088,976

[45] May 9, 1978

[54] THERMALLY OPERATED BIMETAL ACTUATOR

[75] Inventor: Lon E. Bell, Altadena, Calif.

[73] Assignee: Technar, Inc., Arcadia, Calif.

[21] Appl. No.: 622,024

[22] Filed: Oct. 14, 1975

[51] Int. Cl.[2] ..... H01H 61/02; H01H 71/16

[52] U.S. Cl. ..... 337/107; 337/365; 337/370

[58] Field of Search ..... 337/89, 99, 100, 101, 337/102, 103, 104, 107, 111, 53, 343, 354, 365, 95, 105, 370, 378, 379, 377

[56] References Cited

U.S. PATENT DOCUMENTS

| | | | |
|---|---|---|---|
| 1,492,844 | 5/1924 | Hall | 337/95 |
| 1,881,919 | 10/1932 | Patton | 337/370 |
| 2,113,227 | 4/1938 | Bokeeno | 337/343 |
| 2,284,383 | 5/1942 | Elmer | 337/101 |
| 2,336,408 | 12/1943 | Matthews | 337/379 |
| 2,486,714 | 11/1949 | Koci | 337/378 |
| 2,905,790 | 9/1959 | Markham | 337/103 |
| 3,019,319 | 1/1962 | Anderson | 337/107 X |
| 3,207,872 | 9/1965 | Nauer | 337/95 |
| 3,842,382 | 10/1974 | Bell | 337/107 |

*Primary Examiner*—Harold Broome
*Attorney, Agent, or Firm*—Christie, Parker & Hale

[57] ABSTRACT

A thermally operated actuator useful as a relay, flasher, circuit breaker, or the like, in which a bimetal element is movable by heating and cooling in response to an electrical resistance heater and/or current passing through the bimetal element. In one form of the invention ambient compensation is achieved by rigidly clamping one end of the bimetal element to provide a cantilever support, and providing a support at the other end that either clamps or pivotally engages the bimetal element and longitudinally compresses the element, causing the element to buckle into a curved configuration. Heat is applied selectively to the bimetal element adjacent either end to produce a snap action change in the shape of the element between two fixed positions. In an alternative form of the invention, two parallel bimetal elements are linked together to provide ambient compensation while still providing the snap action change in shape in response to selectively applied heat.

12 Claims, 13 Drawing Figures

Fig. 1
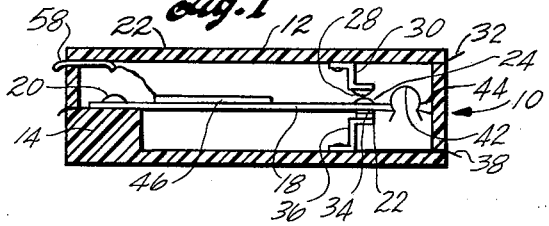
Fig. 2
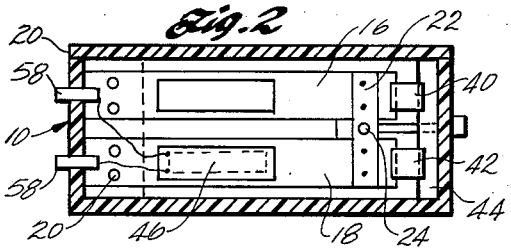
Fig. 3
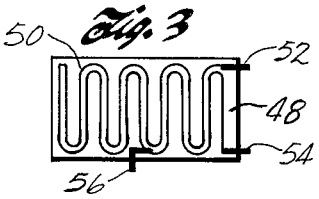
Fig. 4
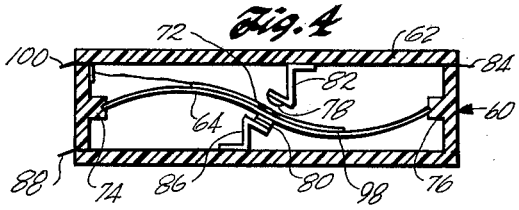
Fig. 5
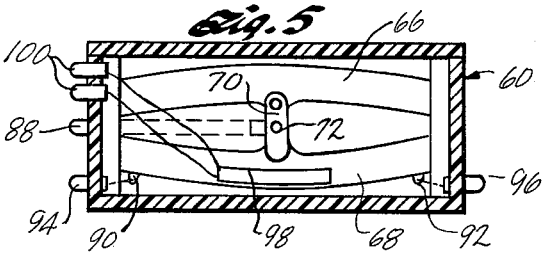
Fig. 6
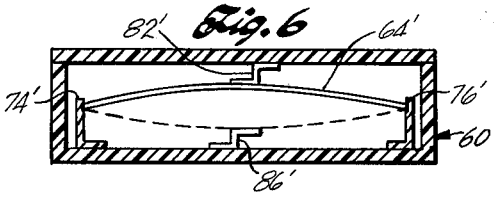
Fig. 7
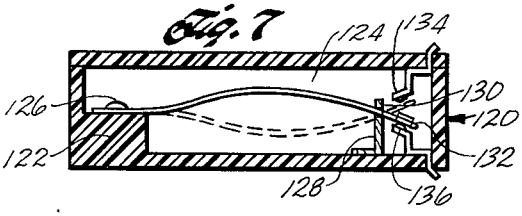
Fig. 8
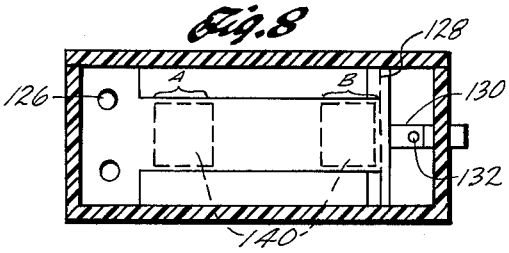
Fig. 9
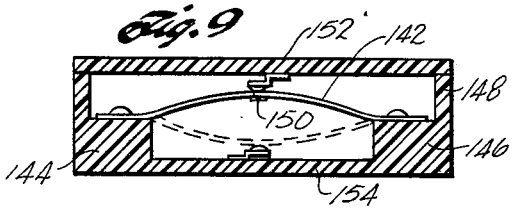
Fig. 10
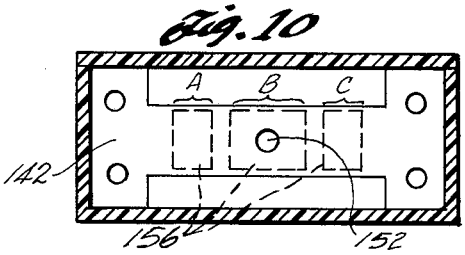
Fig. 11
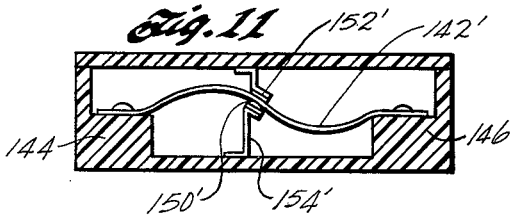
Fig. 12
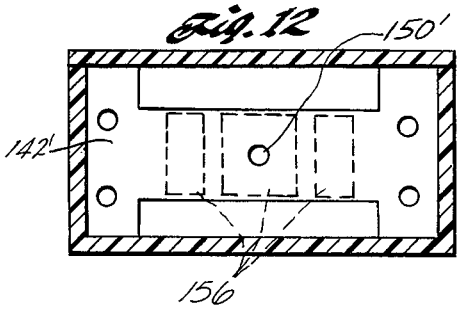
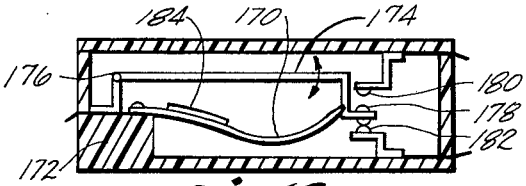
Fig. 13

THERMALLY OPERATED BIMETAL ACTUATOR

FIELD OF THE INVENTION

This invention relates to thermally operated bimetal actuators for use as a relay or the like, and more particularly, is concerned wth ambient temperature compensated snap action bimetal actuators.

BACKGROUND OF THE INVENTION

In my U.S. Pat. No. 3,842,382, issued Oct. 15, 1974, there is described several embodiments of a thermally operated relay or switching device utilizing a bimetal element. By making the bimetal element with the resilience characteristics of a flat spring and by placing the spring in longitudinal compression causing it to buckle into an S-shape bimetal element, an over center or bistable switching element was provided. By heating the bimetal element it could at the same time be cause to flip from one stable state to the other. To make the device insensitive to ambient temperature changes, as disclosed in the patent, the bimetal element was made with the position of the dissimilar metals being reversed over a portion of the length of the element.

SUMMARY OF THE INVENTION

The present invention is directed to an improved bimetal actuator of the type described in the above-identified patent. The present invention is specifically directed to alternative arrangements for achieving ambient temperature compensation while retaining the snap action characteristics of the actuator. In brief, this is achieved in one form of the invention by providing a bimetal element which is clamped at one or both ends to provide a cantilever support at one end with either a cantilever support of a pivot support at the other end of the element. The supports hold the element in compression so that it buckles into a curved shape. By clamping at least one end in this manner the central portion of the element can be caused to snap over center in response to heat applied selectively to a portion of the length of the bimetal element. The element is self-compensating against ambient temperature changes without reversal of the dissimilar metals.

In an alternative embodiment the bimetal element is made up of two parallel bimetal strips which are relatively isolated from each other thermally but are joined together in a manner which provides offsetting forces in response to ambient temperature changes. Heating of one of the sections trips the device.

DESCRIPTION OF THE DRAWINGS

For a more complete understanding of the invention, reference should be made to the accompanying drawings, wherein:

FIG. 1 is a cross-sectional view of one embodiment of the invention;

FIG. 2 is a top view of the embodiment of FIG. 1;

FIG. 3 is a detailed view of the heater element;

FIG. 4 is a cross-sectional view of a further embodiment of the invention;

FIG. 5 is a top view of the embodiment of FIG. 4;

FIG. 6 is a cross-sectional view of a further embodiment of the invention;

FIG. 7 is a cross-sectional view of a further embodiment of the invention;

FIG. 8 is a top view of the embodiment of FIG. 7;

FIG. 9 is a cross-sectional view of a further embodiment of the invention;

FIG. 10 is a top view of the embodiment of FIG. 9;

FIG. 11 is a cross-sectional view of a further embodiment of the invention ;

FIG. 12 is a top view of the embodiment of FIG. 11, and FIG. 13 is a cross-sectional view of a further embodiment of the invention.

DETAILED DESCRIPTION

Referring to FIGS. 1–3 in detail, the numeral 10 indicates a relay housing molded of plastic or other suitable insulating material and having a removable top 12 which forms a fully enclosed chamber. One end of the chamber is provided with a ledge 14 on which are mounted a pair of parallel bimetal elements 16 and 18. The elements are secured at one end by suitable screws or rivets 20 to the ledge 14 so that the bimetal elements are clamped in cantilevered position within the housing 10, leaving the outer ends of the elements free to move up and down.

The outer ends of the bimetal elements 16 and 18 are securely tied together by a bridging bar 22 that may be separate or integrally formed. A moving contact 24 is secured to and projects from opposite sides of the bar 22. The contact 24 is opposed on one side by a fixed contact 28 supported from the top 12 by a supporting bracket 30 having a lug 32 extending outside the housing for making an external electrical connection. A second fixed contact 34 is positioned opposite the other end of the contact 24 and is mounted on a bracket 36 secured to the bottom of the housing. The bracket connects to a lug 38 extending outside the housing for making an external electrical connection.

To provide snap action, a pair of springs 40 and 42 are provided which are compressed and inserted between the outer ends of the respective bimetal elements 16 and 18 and a ridge 44 in the opposing end wall of the housing. The springs may be U-shaped, as shown, or coil springs that act to place the bimetal elements under longitudinal pressure causing them to be deflected. A heating element 46 is mounted on one or both of the bimetal elements. The heating element 46 is preferably of a type shown in FIG. 3 and similar to that described in the above-identified patent. The heater includes a substrate 48 of a very thin, flexible nonconductive material on which a serpentine conductive pattern 50 is formed by a conventional printed circuit, vapor deposition, or other well known technique to provide a current conductive path between two integral or supplemental terminals 52 and 54. A terminal 56 may be provided at an intermediate point along the conductive path, if desired, to provide a lower resistance heater, thus permitting the same heater element to be operated at different ratings. The heater 46 is secured to the surface of the bimetal element 18, for example, by cementing it or bonding it directly to the metal. Electrical leads connect the terminals of the heater element 46 to a pair of external connector lugs 58.

In operation, the bimetal elements 16 and 18 have the dissimilar metals reversed so that the bimetal elements tend to bend in opposite directions with changes in temperature. Since the moving ends are rigidly tied together by the bridging bar 22, changes in ambient temperature produce no net movement of the bar 22. By heating only one of the elements 16 or 18, the bar 22 is moved, causing the elements to move together in a direction that compresses the springs. The springs 40 and 42, when the elements move over center, produce a snap action of the switch.

Referring to FIGS. 4 and 5, there is shown a bimetal actuator utilizing an S-shaped bimetal element similar to that shown in the above-identified patent. The actuator is shown in the form of a relay having a housing 60 with a removable top 62. The bimetal element, indicated generally at 64, is preferably H-shaped in form, as shown in FIG. 5. The bimetal element 64 is constructed of two separate T-shaped sections 66 and 68. Each section is formed with an integrally formed arm 70 in the center. The arms 70 of the two sections are placed in overlapping relationship and riveted or otherwise clamped together at 72. The fastening means may also provide an electrical contact. The two sections 66 and 68 are arranged such that the dissimilar metals in the two sections are reversed, that is, the higher coefficient of expansion metal is uppermost in the section 66 while the lower coefficient of expansion metal is uppermost in the section 68. Thus the two sections tend to bend in opposite directions with change in the ambient temperature.

The opposite ends of the sections 66 and 68 of the bimetal element 64 engage slots 74 and 76 at opposite ends of the housing 60. The length of the bimetal sections is greater than the space between the slots 74 and 76 so that the bimetal element must be compressed to fit in the slots, causing the bimetal element either to form a continuous arc as in FIG. 6, or form a reverse arc or S-shape as in FIG. 4. The S-shape is preferred as the inherent compliance of the S-shape produces a reproducibly controlled snap. The configuration of FIG. 6 preferably utilizes additional compliance, such as pivots 74′ and 76′ which spring outwardly to control the snap motion. However, both configurations provide an over center action. In the arrangement of FIG. 4, the S-shape, of course, is unstable and only is maintained by restricting the range of movement of the modal point at the center. This is accomplished by a pair of fixed stationary contacts 78 and 80 positioned on opposite sides of the moving contact 72. The contact 78 is supported from the top 62 by a suitable bracket 82 which is electrically connected to an external lug 84. Similarly the contact 80 is supported from the bottom of the housing by a suitable bracket 86 terminating in an external lug 88. Electrical connection to the contact 72 is provided by a pair of entegral lugs 90 and 92 at either end of the section 68 of the bimetal element 64, the section 68 providing a conductive path between the lugs and the contact 72. The lugs 90 are electrically connected to external connections 94 and 96, respectively, through flexible conductors.

Switching is provided by heating either leg of the bimetal element separately, such as by a heater element 98 connected to a pair of external connections 100.

In operation, any change in ambient temperature causes no net movement of the contact 72 because of the counterbalancing effect of the bimetal sections 66 and 68. However, heating of one leg of the section 68 by the heater 98 causes the contact 72 to shift from the fixed contact 80 to the fixed contact 78. Since the spring formed by the bimetal element 64 is in a lower energy state when biased either against the fixed contact 78 or the fixed contact 80, a snap action takes place. It should be noted that by passing the current through the bimetal section 68, the load current can produce heating of the bimetal element. If the load current is large, this heating may have an adverse effect on the operation of the actuator. In such case an output lead may be connected directly to the center section of the bimetal element. In some cases the internal heating effect may be used to advantage, such as to provide a latching effect to hold the switch in a closed position and turning off the heating element. It also may be used to provide a circuit breaker effect so that a current overload heats the bimetal element sufficiently to switch the actuator and break the load circuit.

The actuator device of FIG. 6 is substantially similar to that of FIG. 4 except for the compressed shape of the bimetal element. The top view of the embodiment of FIG. 6 would look substantially identical to FIG. 5. By applying heat to one section of the bimetal element in the same manner as described above in connection with FIG. 4, the bimetal element of FIG. 6 can be distorted sufficiently by the application of heat to cause it to snap over center and become polarized against the opposite stationary contact. In either the arrangement of FIG. 4 or FIG. 6, the bimetal element is constructed in two distinct sections which compensate each other for ambient temperature changes.

An alternative arrangement for achieving ambient compensation in a thermally operated snap action switch is shown in FIGS. 7–13. In each of these embodiments at least one end of the bimetal element is rigidly clamped to a supporting surface to form a cantilever support. Thus in the arrangement of FIGS. 7 and 8, a housing 120 is provided with a step of ledge 122 at one end to which one end of a bimetal strip 124 is secured by suitable screws or rivets 126. The other end of the bimetal element 124 pivotally engages a bracket 128. A contact portion 130 projects from the end of the bimetal element 124, passing through an opening in the bracket 128. The contact portion 130 has an electrical contact 132 which moves between a pair of stationary contacts 134 and 136 as the bimetal element moves between the solid line position and the dotted line position. The bimetal element 124 may have two stable positions at a particular temperature, or by prebending the bimetal element at the cantilver support end, the bimetal element may be permanently biased toward one of the two positions. A heating element 140 may be applied to the surface of the bimetal element 124 at either or both positions A and B. Heat applied at position A causes the bimetal strip to move to one of the two positions, whereas heat applied at B causes it to move to the opposite position. Thus the device of FIGS. 7 and 8 may be operated as a latching device which can be moved to either stable position by applying heat respectively at position A or position B on the bimetal strip. Alternatively, by bending or otherwise biasing the bimetal strip to one position or the other, it can be caused to move alternately between the two positions by applying heat or removing heat at one or the other of the locations A or B.

In the arrangement of FIGS. 9 and 10, both ends of the bimetal strip 142 are clamped to ledges 144 and 146 at either end of a housing 148. A moving contact 150 at the center of the element 142 engages a fixed contact 152 when in a first position, but moves against a second fixed contact 154 when in the dotted position. Heating elements 156 may be applied to the surface of the bimetal strip at one or all of three positions A, B, and C. Heat applied at positions A or C cause the bimetal strip to move toward one fixed contact, while heat applied at position B causes it to move toward the opposite contact. Again the bimetal element may be biased toward one contact or the other by permanently bending it slightly adjacent the supporting ledge.

The arrangement shown in FIGS. 11 and 12 is similar to that shown in FIGS. 9 and 10 except that the bimetal element is compressed into an S-shaped configuration and constrained by the fixed contacts. Again heat may be applied to the bimetal 142' by heaters 156' at regions A, B, and/or C, as shown in FIG. 12. Heat applied at A or C causes the bimetal to move toward one contact with a snap action, while heat applied at region B causes it to move in the opposite direction.

In each of the embodiments shown in FIGS. 7–12, the bimetal elements are uniform throughout their lengths, that is, the same one of the dissimilar metals extends on one side of the element through its length, rather than being reversed in the manner described in the above-identified patent. The bimetal element is self-compensating for change in ambient temperature. The reason is that by clamping one end in a cantilever fashion and pivoting or clamping the other end, the center of the bimetal strip tends to be moved in an opposite direction as the cantilevered end or ends in response to temperature rise. Heat applied uniformly in positions A, B, and C therefore produces no net shift of the center of the bimetal element between its two positions. Selective heating of either the ends or the center of the bimetal element causes the element to move from one position to the other.

FIG. 13 shows a further embodiment in which a bimetal element 170 is clamped to a strip 172 but the opposite end is pivotally supported by support member 174 which is itself pivotally supported at one end to the strip 172 by a hinge connection, as indicated at 176. A moving contact 178 carried by the support member 174 moves between a pair of fixed contacts 180 and 182. The bimetal is compressed into a curved shaped as shown. A heater 184 applies heat to the end of the bimetal adjacent the cantilevered end to cause the bimetal to bend and act as an over-center spring. Ambient temperature compensation may be achieved in the same manner as shown in FIG. 1 by providing a pair of parallel bimetal elements that bend in opposite directions but are constrained to move together at the ends.

From the above description it will be seen that thermally operated bimetal actuators are provided which shift abruptly between two predetermind positions by controlled applications of heat. All of the actuators thus produce a snap action. At the same time all of the devices are ambient temperature compensated. All of the actuators can be moved to either of the two positions by selective application of heat, thus making them useful also as binary logic devices. While the width of the bimetal elements is shown as uniform, the width may be varied to achieve modified bending characteristics along the length of the strip.

What is claimed is:

1. An ambient temperature compensated thermal actuator device for operating switches or the like comprising an elongated thin bimetal element in which the same metal is on the same side of the element throughout its length, first support means anchoring one end of the element along a portion of the length to provide a cantilevered support, second support means attached to the first support means engaging the bimetal element adjacent the other end and constraining the element lengthwise under compression between the two support means, whereby the bimetal element buckles into a curved shape, and heater means for applying heat selectively to only limited areas of the bimetal element between the supports, the heater means including a substrate of very thin flexible nonconductive material applied to a small portion of one surface of the bimetal element between the support means, and serpentine-shaped conductive pattern forming an electrical resistance heater on the surface of the nonconductive material.

2. Apparatus of claim 1 wherein the heater means includes means for producing a temperature differential between the portion of the bimetal element immediately adjacent the cantilever support and the portion intermediate the two support means.

3. Apparatus of claim 1 wherein the second support means pivotally engages the bimetal element adjacent one end.

4. Apparatus of claim 1 wherein the second support means anchors the other end of the bimetal element along a portion of the length, whereby both ends of the element are anchored in a cantilevered support.

5. Apparatus of claim 3 wherein said heater means changes the temperature along at most a third of the length immediately adjacent the cantilever supported end by a different amount than the temperature over the remaining length of the element.

6. Apparatus of claim 4 wherein said heater means changes the temperature adjacent to either one of the supports by a different amount than the temperature over the intermediate portion.

7. Apparatus of claim 4 wherein the portion of the bimetal element intermediate the first and second support means is compressed into an unstable S-shaped, and limit means is positioned to limit the lateral movement of the bimetal element and prevent it from springing into a stable shape.

8. A thermal actuator comprising a frame, a bimetal element having at least two or more elongated bimetal sections extending in side-by-side relationship and in force communication with each other at an intermediate point along the lengths thereof, support means engaging both ends of the elongated sections, the support means constraining both sections of the bimetal element in longitudinal compression and deforming their shape, and heater means for applying heat to at least one of said sections to cause the section to bend in a direction toward a position of higher compression, the support means pivotally engaging both ends of the elongated sections, the two sections being made of bimetal in which the dissimilar metals are reversed relative to each other, whereby the sections tend to bend in opposite directions along their length with change in temperature.

9. Apparatus of claim 8 wherein the bimetal element is H-shaped with the sections forming the two substantially parallel sides, and means rigidly joining the two sections together at an intermediate point along their lengths.

10. Apparatus of claim 8 wherein the bimetal sections are compressed into an unstable S-shape by the supporting means, and spaced limit means are positioned to engage at least one of the sections to limit the lateral movement of the element and prevent it from springing into a stable shape.

11. Apparatus of claim 8 including one or more electrical contacts movable with the bimetal element and fixed electrical contacts positioned opposite the moving contacts, movement of the element closing electrical circuits when the contacts are brought together by movement of the thermal actuator.

12. Apparatus of claim 11 wherein the support means is nonconductive and the sections of the bimetal element is conductive, the moving contacts being electrically connected to the bimetal element, whereby the bimetal element forms an, electrical path to the moving contacts.

* * * * *